US011675301B2

(12) United States Patent
Onishi et al.

(10) Patent No.: US 11,675,301 B2
(45) **Date of Patent: *Jun. 13, 2023**

(54) IMAGE FORMING APPARATUS AND IMAGE FORMING METHOD THAT ACCOUNTS FOR DETERIORATION OF A DEVELOPER

(71) Applicant: TOSHIBA TEC KABUSHIKI KAISHA, Tokyo (JP)

(72) Inventors: Kei Onishi, Sunto Shizuoka (JP); Satoshi Itaya, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/668,427

(22) Filed: Feb. 10, 2022

(65) Prior Publication Data

US 2022/0269203 A1 Aug. 25, 2022

Related U.S. Application Data

(63) Continuation of application No. 17/095,792, filed on Nov. 12, 2020, now Pat. No. 11,281,143, which is a continuation of application No. 16/564,097, filed on Sep. 9, 2019, now abandoned.

(51) Int. Cl.
*G03G 15/00* (2006.01)
*G03G 15/08* (2006.01)

(52) U.S. Cl.
CPC ..... *G03G 15/5008* (2013.01); *G03G 15/0849* (2013.01); *G03G 2215/00075* (2013.01); *G03G 2215/00945* (2013.01)

(58) Field of Classification Search
None
See application file for complete search history.

(56) References Cited

U.S. PATENT DOCUMENTS 7,296,873 B2 11/2007 Harada et al.
8,433,216 B2 4/2013 Ishikake et al.
11,281,143 B2 * 3/2022 Onishi ..... G03G 15/0849
(Continued)

FOREIGN PATENT DOCUMENTS

JP 2007-206412 8/2007

OTHER PUBLICATIONS

Non-Final Office Action for U.S. Appl. No. 16/564,097 dated Apr. 2, 2020.

(Continued)

*Primary Examiner* — Thomas D Lee
(74) *Attorney, Agent, or Firm* — Amin, Turocy & Watson, LLP

(57) ABSTRACT

According to one embodiment, an image forming apparatus includes a printer and a controller. The printer performs image formation on a sheet at a first speed relating to a speed of image formation or at a second speed slower than the first speed. The controller acquires information on deterioration of developer contained in an own apparatus, and controls the printer to perform image formation at the first speed when the information does not satisfy a predetermined condition indicating that the developer is deteriorated and to perform image formation at the second speed when the information satisfies the predetermined condition.

20 Claims, 3 Drawing Sheets

(56) References Cited

U.S. PATENT DOCUMENTS

| | | | |
|---|---|---|---|
| 2003/0219263 | A1 | 11/2003 | Tsuzuki |
| 2009/0003851 | A1 | 1/2009 | Nishi |
| 2009/0269094 | A1 | 10/2009 | Mitsui |

OTHER PUBLICATIONS

Final Office Action for U.S. Appl. No. 16/564,097 dated Sep. 11, 2020.
Ex parte Quayle Action for U.S. Appl. No. 17/095,792 mailed Aug. 18, 2021.
U.S. Appl. No. 17/095,792, filed Nov. 12, 2020.
U.S. Appl. No. 16/564,097, filed Sep. 9, 2019.

* cited by examiner

IMAGE FORMING APPARATUS AND IMAGE FORMING METHOD THAT ACCOUNTS FOR DETERIORATION OF A DEVELOPER

CROSS-REFERENCE TO RELATED APPLICATIONS

This application is a Continuation of application Ser. No. 17/095,792 filed on Nov. 12, 2020, which is a Continuation of application Ser. No. 16/564,097 filed on Sep. 9, 2019, the entire contents of both of which are incorporated herein by reference.

FIELD

Embodiments described herein relate generally to an image forming apparatus and an image forming method.

BACKGROUND

Examples of developer used in an image forming apparatus include two-component developer composed of a toner and a carrier. The two-component developer deteriorates in accordance with drive of a developing device. The deteriorated two-component developer tends to scatter in the image forming apparatus. For that reason, in order to prevent scattering of the deteriorated two-component developer, the image forming apparatus may perform an operation such as stopping an image forming operation, notifying of replacement of developer, or the like. However, such an operation may cause inconvenience for a user or may cause inconvenience such as an increase in the number of maintenance steps of the image forming apparatus.

DETAILED DESCRIPTION

In general, according to one embodiment, an image forming apparatus includes a printer and a controller. The printer performs image formation on a sheet at a first speed relating to a speed of image formation or at a second speed slower than the first speed. The controller acquires information on deterioration of developer contained in an own apparatus, and controls the printer to perform image formation at the first speed when the information does not satisfy a predetermined condition indicating that the developer is deteriorated and to perform image formation at the second speed when the information satisfies the predetermined condition.

Figure 1:
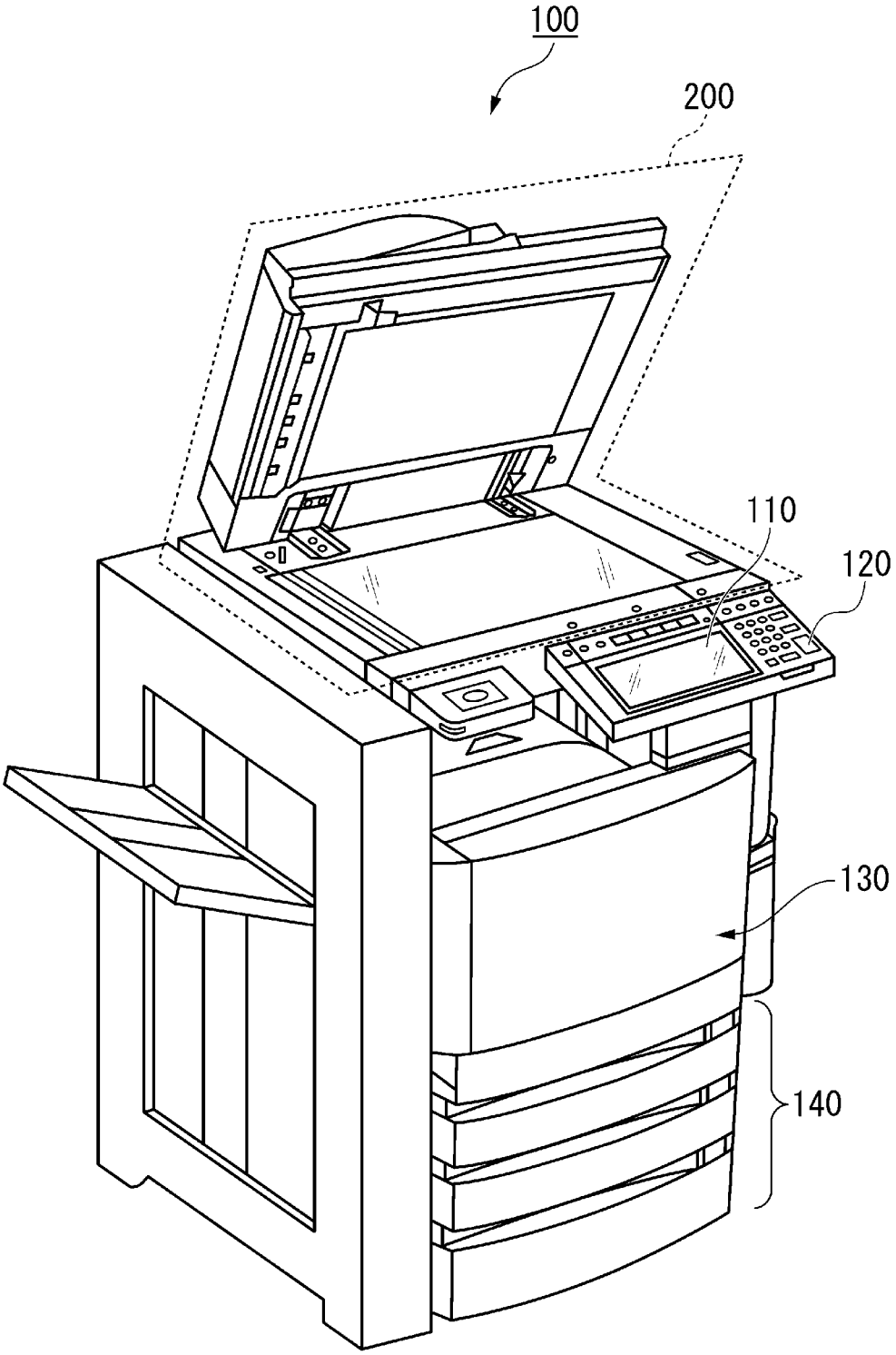
FIG. 1 is an external view illustrating an example of the entire configuration of an image forming apparatus of an embodiment.

FIG. 1 is an external view illustrating an example of the entire configuration of an image forming apparatus 100 of the embodiment. The image forming apparatus 100 is, for example, a multifunction apparatus. The image forming apparatus 100 includes a display 110, a control panel 120, a printer 130, a sheet accommodating unit 140, and an image reading unit 200. The printer 130 of the image forming apparatus 100 may be a device for fixing a toner image.

The image forming apparatus 100 forms an image on a sheet using developer such as a toner. The sheet is, for example, paper or label paper. The sheet may be anything as long as the image forming apparatus 100 can form an image on a surface thereof.

The display 110 is an image display device such as a liquid crystal display or an organic electro luminescence (EL) display. The display 110 displays various types of information relating to the image forming apparatus 100.

The control panel 120 includes a plurality of buttons. The control panel 120 receives an operation of the user. The control panel 120 outputs a signal corresponding to the operation performed by the user to a controller of the image forming apparatus 100. The display 110 and the control panel 120 may be configured as an integral touch panel.

The printer 130 forms an image on a sheet based on image information generated by the image reading unit 200 or image information received via a communication path. The printer 130 forms an image by the following process, for example. An image forming unit of the printer 130 forms an electrostatic latent image on a photoreceptor drum based on the image information. The image forming unit of the printer 130 forms a visible image by adhering a developer onto the electrostatic latent image. A specific example of a developer is a toner. A transfer unit of the printer 130 transfers the visible image to the sheet. A fixing unit of the printer 130 fixes the visible image to the sheet by heating and pressing the sheet. The sheet on which the image is formed may be a sheet accommodated in the sheet accommodating unit 140 or a manually fed sheet. Hereinafter, in this embodiment, the developer is described as a two-component toner composed of a carrier and a toner.

The sheet accommodating unit 140 accommodates sheets used for image formation in the printer 130.

The image reading unit 200 reads image information to be read as light and dark of light. The image reading unit 200 records the read image information. The recorded image information may be transmitted to another information processing device via a network. The recorded image information may be an image formed on the sheet by the printer 130.

Figure 2:
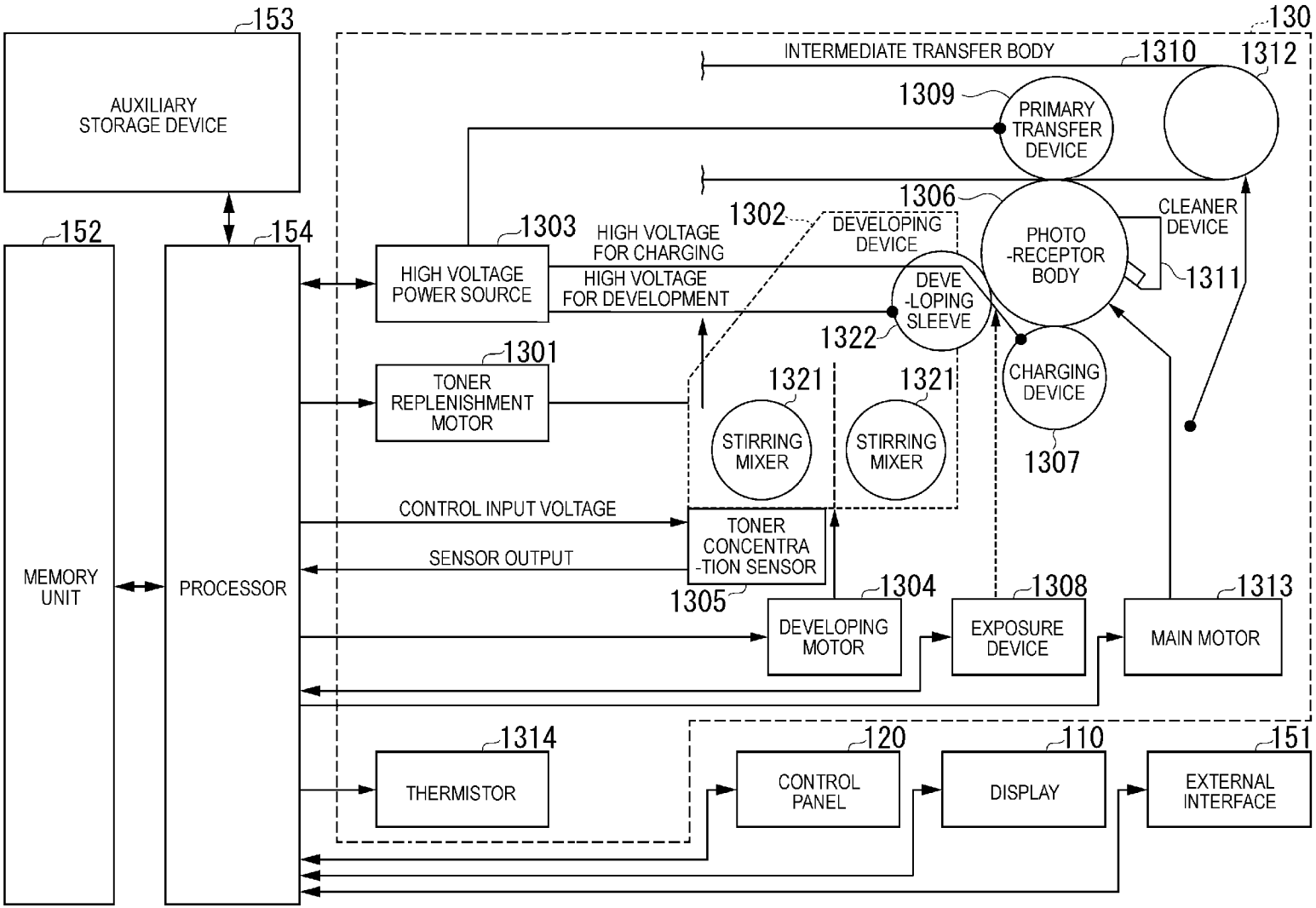
FIG. 2 is a hardware configuration diagram illustrating a hardware configuration of the image forming apparatus of the embodiment.

FIG. 2 is a hardware configuration diagram illustrating a hardware configuration of the image forming apparatus of the embodiment. The image forming apparatus 100 includes the display 110, the control panel 120, the printer 130, an external interface 151, a memory unit 152, an auxiliary storage device 153, and a processor 154. The display 110 and the control panel 120 described above, and thus the description thereof is omitted. Hereinafter, the printer 130, the external interface 151, the memory unit 152, the auxiliary storage device 153, and the processor 154 will be described. Respective functional units are connected to each other so as to be capable of data communication via a system bus (not illustrated).

The external interface 151 is a network interface. The external interface 151 communicates with other communication devices via a network according to a predetermined protocol. The other communication apparatus may be, for example, an information processing apparatus which is a transmission source of the print job.

The memory unit 152 temporarily stores data used by each functional unit included in the image forming apparatus 100. For example, the memory unit 152 stores a normal speed printing sequence, a low speed printing sequence, a drive time integrated value, and a drive time threshold value. The memory unit 152 may store digital data generated by the image reading unit 200. The memory unit 152 may temporarily store a print job and a log relating to the print job.

The normal speed printing sequence is a control sequence for forming an image on a sheet by the printer 130. In the normal speed printing sequence, the printer 130 forms the image on the sheet at a normal process speed. The normal process speed is, for example, a rotation speed of a photoreceptor body determined by the specifications of the image forming apparatus 100. At the normal process speed, for example, the photoreceptor may rotate at a circumferential speed of 225 mm/sec, but is not limited thereto. For example, the process speed may be faster or slower than 225 mm/sec depending on the type of the image forming apparatus 100. The normal process speed is one specific example of a first speed relating to the speed of image formation.

The low speed printing sequence is a control sequence for forming an image on a sheet by the printer 130. In the low speed printing sequence, the printer 130 forms an image on a sheet at a speed slower than the normal process speed in the image forming apparatus 100. The speed that is slower than the normal process speed is, for example, a speed at which contamination inside the image forming apparatus 100 due to a scattering of the developer accompanying drive of a development sleep 1304 can be suppressed. With the speed slower than the normal process speed, for example, the photoreceptor may rotate at a circumferential speed of 150 mm/sec, but is not limited thereto. The speed slower than the normal process speed may be faster or slower than 150 mm/sec, as long as the contamination inside the image forming apparatus 100 can be suppressed. The speed slower than the normal process speed is a specific example of the second speed.

The drive time integrated value is an integrated value of the drive time of a developing motor. The drive time integrated value is measured by the processor 154. The drive time integrated value is associated with the developer container accommodated in the image forming apparatus 100. The drive time integrated value is reset to 0 when the associated developer container is replaced. When a plurality of developer containers is accommodated in the image forming apparatus 100, the drive time integrated value is associated with each developer container. The drive time integrated value is a specific example of information relating to deterioration of the developer provided in the own apparatus.

The drive time threshold value is a value relating to the life of the developer contained in the developer container. When the drive time integrated value becomes equal to or greater than the drive time threshold value, it is determined that the developer contained in the developer container associated with the drive time integrated value exceeds a set life. The drive time threshold value is stored in the memory unit 152 in advance. As the drive time threshold value, different values may be used depending on the type of developer. The type of developer is, for example, a decolorable toner, a non-decolorable toner (normal toner) or a decorative toner. The drive time threshold value is a specific example of a predetermined condition indicating that the developer is deteriorated.

The auxiliary storage device 153 is, for example, a hard disk or a solid state drive (SSD), and stores various types of data. The various types of data are, for example, a program, a print job, digital data, and a log relating to the print job.

The processor 154 controls an operation of each functional unit of the image forming apparatus 100. The processor 154 loads a program stored in the auxiliary storage device 153 onto the memory unit 152, and executes a process by executing the program. Here, a specific process of the processor 154 will be described by taking an example. The processor 154 sets any one of a plurality of printing sequences including a normal speed printing sequence and a low speed printing sequence in the image forming apparatus 100. When the print job is received, the processor 154 controls the printer 130 in accordance with the set printing sequence. The processor 154 controls the printer 130 to form an image on a sheet. The processor 154 measures the drive time of the developing motor when controlling the printer 130 in the normal speed printing sequence. When image formation is ended, the processor 154 adds the measured drive time to the drive time integrated value recorded in the memory unit 152. The processor 154 compares the drive time integrated value with the drive time threshold value. When the drive time integrated value is equal to or greater than the drive time threshold value, the processor 154 determines that the developer contained in the development container associated with the drive time integrated value exceeds the life. When it is determined that the life is exceeded, the processor 154 sets the low speed printing sequence.

The printer 130 includes a toner replenishment motor 1301, a developing device 1302, a high voltage power source 1303, a developing motor 1304, a toner concentration sensor 1305, a photoreceptor body 1306, a charging device 1307, an exposure device 1308, a primary transfer device 1309, an intermediate transfer body 1310, and a cleaner device 1311, a transfer roller 1312, a main motor 1313, and a thermistor 1314. The functional units included in the printer 130 are controlled by the processor 154.

The toner replenishment motor 1301 is rotationally driven to supply the toner contained in the developer container to the developing device 1302. A rotation speed of the toner replenishment motor 1301 is controlled by control of the processor 154.

The developing device 1302 includes a plurality of stirring mixers 1321 and a developing sleeve 1322. The developing device 1302 causes the toner to adhere to the electrostatic latent image formed on the surface of the photoreceptor body 1306.

Each stirring mixer 1321 stirs the toner supplied to the developing device 1302. A positive electric charge is imparted to the toner by frictional charging during stirring. The toner to which electric charge is imparted adheres to the developing sleeve 1322. The developing sleeve 1322 supplies the adhered toner to the photoreceptor body 1306. Specifically, the developing sleeve 1322 is charged by a high voltage for development. The toner adheres to the developing sleeve 1322 by the high voltage for development. The developing sleeve 1322 charged by the high voltage for development attracts the charged toner. The developing sleeve 1322 causes the attracted toner to contact or approach the electrostatic latent image on the photoreceptor body 1306, thereby causing the toner to adhere to the electrostatic latent image of the photoreceptor body 1306. The toner which exceeded the life may not reach regular electric charge due to frictional charging. When the toner that is not reached the regular electric charge adheres to the developing sleeve 1322, the toner may be scattered due to rotation of the developing sleeve 1322. The scattered toner causes internal contamination of the image forming apparatus 100.

The high voltage power source 1303 supplies the high voltage for development to the developing sleeve 1322. The high voltage power source 1303 supplies a high voltage for charging to the charging device 1307. The high voltage for charging is a voltage that imparts negative electric charge to the surface of the photoreceptor body 1306. The high voltage power supply 1303 supplies a high voltage for transfer to the primary transfer device 1309. The high voltage for transfer is a voltage that causes the toner to adhere to the intermediate transfer body 1310 from the photoreceptor body 1306.

The developing motor 1304 rotates the developing sleeve 1322 by being rotationally driven. A rotation speed of the developing motor 1304 is controlled by control of the processor 154. For example, when the normal speed printing sequence is set in the memory unit 152, the developing motor 1304 is rotationally driven at a speed according to the normal process speed. When the low speed printing sequence is set in the memory unit 152, the developing motor 1304 is rotationally driven at a speed slower than a speed corresponding to the normal process speed. When the normal speed printing sequence is set in the memory unit 152, the drive time of the developing motor 1304 is measured by the processor 154.

The toner concentration sensor 1305 receives a control input voltage from the processor 154 to detect a concentration of the toner in the developing device 1302. The toner concentration sensor 1305 outputs the detected concentration of the toner to the processor 154. The processor 154 controls the rotation speed of the toner replenishment motor 1301 in accordance with the concentration of the toner. For example, when the concentration of the output toner is greater than a predetermined threshold value relating to the concentration of toner, the processor 154 determines that the toner is sufficiently supplied to the developing device 1302. When it is determined that the toner is sufficiently supplied, the processor 154 performs control to stop or suppress drive of the toner replenishment motor 1302. When the concentration of the output toner is equal to or less than the predetermined threshold value relating to the concentration of toner, the processor 154 determines that the toner is not sufficiently supplied to the developing device 1302. When it is determined that the toner is not sufficiently supplied, the processor 154 performs control to drive the toner replenishment motor 1302.

The photoreceptor body 1306 causes the toner (visible image) adhered to the electrostatic latent image to adhere to the intermediate transfer body 1310. Specifically, the photoreceptor body 1306 is charged by contacting the charging device 1307. The photoreceptor body 1306 forms an electrostatic latent image in accordance with light exposed from the exposure device 1308. The charged photoreceptor body 1306 contacts or approaches the developing sleeve 1322 to cause the toner to adhere to the electrostatic latent image, thereby forming the visible image. The photoreceptor body 1306 causes the toner to adhere to the intermediate transfer body 1310 by a voltage of the primary transfer device 1309 charged at the high voltage for transfer. The cleaner device 1311 removes the toner that is not adhered to the intermediate transfer body 1310 from the photoreceptor body 1306.

The transfer roller 1312 moves the intermediate transfer body 1310 by rotating. The transfer roller 1312 moves the intermediate transfer body 1310 to which the visible image is adhered to transfer the visible image to a conveyed sheet.

The main motor 1313 rotationally drives each device such as the photoreceptor body 1306, the charging device 1307, and the transfer roller 1312. A rotation speed of the main motor 1313 is controlled by control of the processor 154. For example, when the normal speed printing sequence is set in the memory unit 152, the main motor 1313 is rotationally driven at a speed according to the normal process speed. For example, when the low speed printing sequence is set in the memory unit 152, the main motor 1313 is rotationally driven at a speed slower than the speed corresponding to the normal process speed.

The thermistor 1314 detects the temperature of a fixing unit (not illustrated). The thermistor 1314 outputs the detected temperature of the fixing unit to the processor 154.

Figure 3:
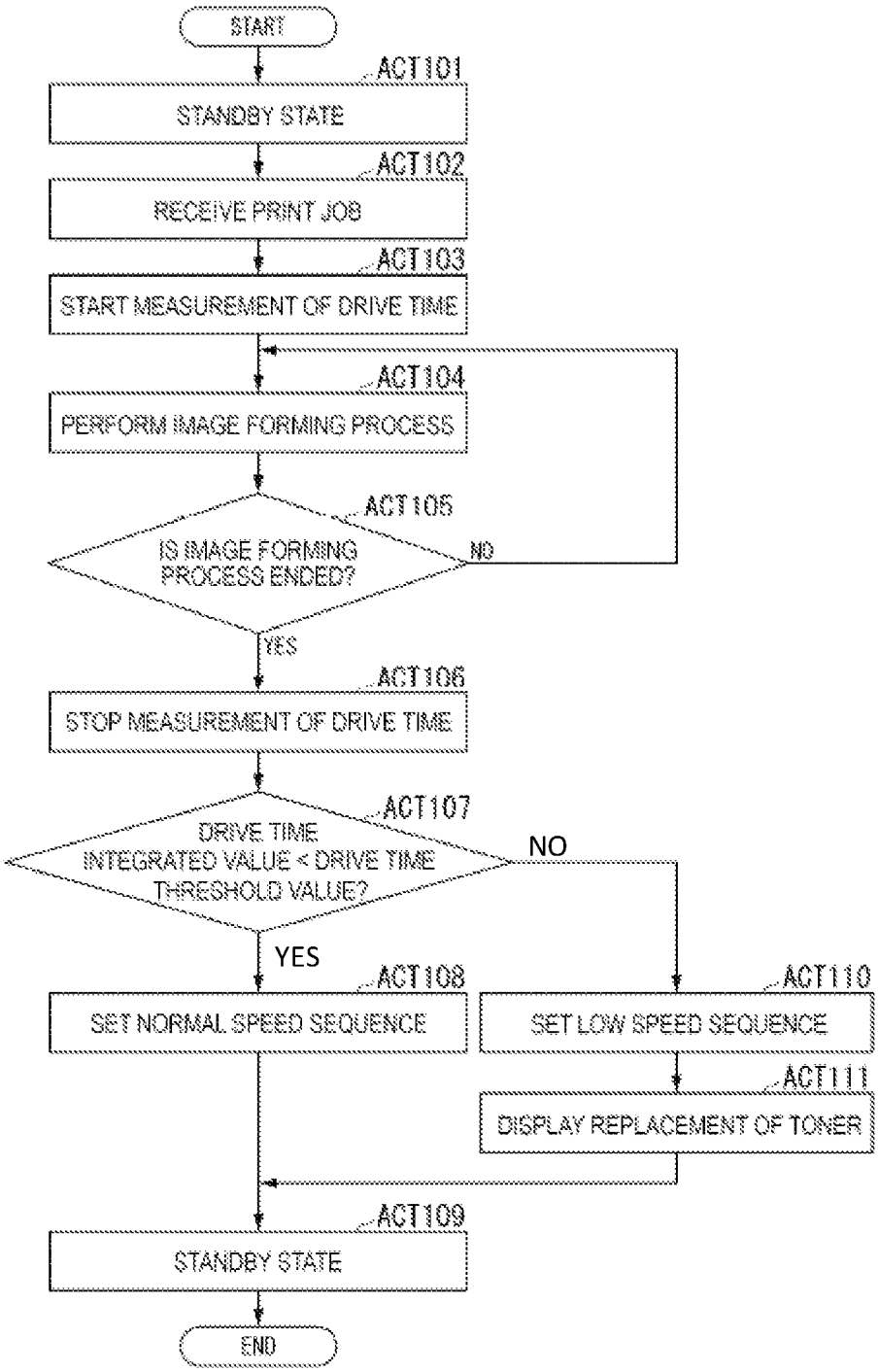
FIG. 3 is a flowchart illustrating a flow of a process of the image forming apparatus of the embodiment.

FIG. 3 is a flowchart illustrating a flow of a process of the image forming apparatus of the embodiment. When the image forming apparatus 100 executes a print job, the process of FIG. 3 is performed. The print job may be copying, printing, or printing of a received FAX. The print job may be any job as long as it relates to image formation. The print job includes digital data to be subjected to image formation. In FIG. 3, the image forming apparatus 100 is the one having the normal speed printing sequence set as the printing sequence.

The image forming apparatus 100 is in a standby state until a print job is received (ACT 101). The standby state is a state in which the image forming apparatus 100 is not performing the process relating to image formation. The image forming apparatus 100 receives a print job (ACT 102). The image forming apparatus 100 may receive the print job from the user via the control panel 120. The image forming apparatus 100 may receive a print job relating to printing of predetermined digital data from an external information processing apparatus. The image forming apparatus 100 may receive a print job relating to the printing of a FAX from an external communication apparatus.

The processor 154 of the image forming apparatus 100 acquires the drive time integrated value from the memory unit 152. The processor 154 starts measurement of the drive time (ACT 103). Specifically, the processor 154 drives the developing motor 1304 in response to the start of the printing sequence. The processor 154 starts measurement of the drive time in response to the start of drive of the developing motor 1304. The processor 154 performs an image forming process based on the print job and the set printing sequence (ACT 104). In FIG. 3, the normal speed printing sequence is set in the image forming apparatus 100. For that reason, the processor 154 controls the printer 130 at the normal process speed. When the low speed printing sequence is set in the image forming apparatus 100, the image forming apparatus 100 controls the printer 130 at a speed slower than the normal process speed.

The processor 154 determines whether or not the image forming process is ended (ACT 105). Specifically, the processor 154 determines whether or not the image formation of the final page is ended based on digital data targeted for image formation included in the print job. When it is determined that the image forming process is not ended (NO in ACT 105), the process transitions to ACT 104. When it is determined that the image forming process is ended (YES in ACT 105), the processor 154 executes a stop sequence and ends the image forming process. The processor 154 stops measurement of the drive time (ACT 106). The processor 154 calculates the drive time integrated value by adding the measured drive time to the acquired drive time integrated value. The processor 154 records the calculated drive time integrated value in the memory unit 152.

The processor 154 acquires the drive time threshold value from the memory unit 152. The processor 154 determines whether or not the drive time integrated value is smaller than the drive time threshold value (ACT 107). When it is determined that the drive time integrated value is smaller than the drive time threshold value (YES in ACT 107), the processor 154 sets the normal speed printing sequence in the memory unit 152 (ACT 108). The processor 154 performs image formation using the normal speed printing sequence set in the memory unit 152 when performing the next image formation. The image forming apparatus 100 enters the standby state (ACT 109).

When it is determined that the drive time threshold value is smaller than or equal to the drive time integrated value (NO in ACT 107), the processor 154 executes ACT 110 and ACT 111. Specifically, the processor 154 sets the low speed printing sequence in the memory unit 152 (ACT 110). The processor 154 performs image formation using the low speed printing sequence set in the memory unit 152 when performing the next image formation. The processor 154 causes the display 110 to display a display requesting replacement of toner (ACT 111). When the ACT 111 is executed, the image forming apparatus 100 enters the standby state (ACT 109). The image forming apparatus 100 in which the low speed printing sequence is set performs the image forming process in the low speed printing sequence until the drive time integrated value is reset. When the developer container is replaced, the processor 154 resets the drive time integrated value recorded in the memory unit 152. Specifically, the drive time integrated value may be reset by setting the drive time integrated value to zero.

The image forming apparatus 100 configured as described above sets the low speed printing sequence as the printing sequence when the drive time integrated value of the toner becomes equal to or greater than the drive time threshold value. In the low speed printing sequence, the process speed is slower than the normal speed. For that reason, the rotation speed of the developing sleeve 1322 of the developing device 1302 also becomes slow. The toner adhered to the developing sleeve 1322 can be prevented from scattering inside the image forming apparatus 100. Accordingly, maintenance costs such as cleaning and trouble handling caused by toner scattering in the image forming apparatus 100 can be reduced. Further, the image forming apparatus 100 can continue the image forming process in the low speed printing sequence, and convenience of the user can be secured.

In the embodiment described above, the processor 154 is configured to measure the drive time of the developing motor 1304 to obtain the drive time integrated value, but is not limited thereto. For example, the processor 154 may be configured to count the number of sheets on which an image is formed by the image forming apparatus 100. In this case, the processor 154 counts the number of sheets on which an image is formed every time an image is formed on a sheet by the image forming process.

When the image forming process is ended, the processor 154 stops counting the number of sheets. The processor 154 adds the measured number of sheets to the total number of sheets stored in the memory unit 152. The processor 154 records the total number of sheets in the memory unit 152. The processor 154 determines whether or not the total number of measured sheets is smaller than a threshold value relating to the number of sheets. When the total number of sheets is equal to or greater than the threshold value relating to the number of sheets, the processor 154 sets the normal speed printing sequence in the memory unit 152. When the total number of sheets is smaller than the threshold value relating to the number of sheets, the processor 154 sets the low speed printing sequence in the memory unit 152. The total number of sheets is initialized (for example, 0) when the developer container accommodated in the image forming apparatus 100 is replaced. Even with the image forming apparatus 100 configured as described above, it is possible to suppress contamination due to the toner scattered inside the image forming apparatus 100, and it is possible to secure the convenience for the user.

In the embodiment described above, the processor 154 is configured to measure the drive time of the developing motor 1304 to obtain the drive time integrated value, but is not limited to thereto. For example, the processor 154 may be configured to count the number of print jobs performed by the image forming apparatus 100. In this case, the processor 154 counts the number of print jobs executed by the image forming process.

When the image forming process is ended, the processor 154 stops counting the number of print jobs. The processor 154 adds the number of counted print jobs to the number of print jobs stored in the memory unit 152. The processor 154 records the number of print jobs in the memory unit 152. The processor 154 determines whether or not the number of counted print jobs is smaller than a threshold value relating to the number of print jobs. When the number of print jobs is equal to or greater than the threshold value relating to the number of print jobs, the processor 154 sets the normal speed printing sequence in the memory unit 152. When the number of print jobs is smaller than the threshold value relating to the number of print jobs, the processor 154 sets the low speed printing sequence in the memory unit 152. The number of print jobs is initialized (for example, 0) when the developer container accommodated in the image forming apparatus 100 is replaced. Even with the image forming apparatus 100 configured as described above, it is possible to suppress contamination due to the toner scattered inside the image forming apparatus 100, and it is possible to secure convenience for the user.

In the embodiment described above, the processor 154 is configured to measure the drive time of the developing motor 1304 to obtain the drive time integrated value, but is not limited to thereto. For example, the processor 154 may be configured to measure the number of rotations of the toner replenishment motor 1301 performed by the image forming apparatus 100. In this case, the processor 154 measures the number of rotations of the toner replenishment motor 1301 executed by the image forming process.

When the image forming process is ended, the processor 154 stops measuring the rotation speed of the toner replenishment motor 1301. The processor 154 adds the number of measured rotations to the total number of rotations of the toner replenishment motor 1301 stored in the memory unit 152. The processor 154 records the total number of rotations of the toner replenishment motor 1301 in the memory unit 152. The processor 154 determines whether or not the total number of rotations of the toner replenishment motor 1301 is smaller than a threshold value relating to the number of rotations of the toner replenishment motor 1301. When the total number of rotations of the toner replenishment motor 1301 is equal to or greater than the threshold value relating to the number of rotations of the toner replenishment motor 1301, the processor 154 sets the normal speed printing sequence. When the total number of rotations of the toner replenishment motor 1301 is smaller than the threshold value relating to the number of rotation of the toner replenishment motor 1301, the processor 154 sets the low speed printing sequence in the memory unit 152. The total number of rotations of the toner replenishment motor 1301 is initialized (for example, 0) when the developer container accommodated in the image forming apparatus 100 is replaced. Even with the image forming apparatus 100 configured as described above, it is possible to suppress contamination due to the toner scattered inside the image forming apparatus 100, and it is possible to secure convenience for the user.

In the embodiment described above, the processor 154 is configured to set either the normal speed printing sequence or the low speed printing sequence according to the drive time of the developing motor 1304, but is not limited thereto. For example, the processor 154 may be configured to set any one of three or more printing sequences as the printing sequence. For example, the processor 154 may be configured to set a second low speed printing sequence of which a process speed is slower than that of the low speed printing sequence. In this case, the memory unit 152 stores a second drive time threshold value which is a value greater than the drive time threshold value. The processor 154 acquires the second drive time threshold value. The processor 154 may be configured to set the second low speed printing sequence when the drive time integrated value is greater than the second drive time threshold value. In the image forming apparatus 100 configured as described above, scattering of the toner inside the image forming apparatus 100 can be suppressed even when the electric charge imparted by frictional charging is further weakened. For that reason, while reducing maintenance costs for the image forming apparatus 100, the image forming apparatus 100 can ensure convenience for the user. The process speed of the second low speed printing sequence is a specific example of a third speed. The second drive time threshold value is a specific example of a second condition indicating that the developer is more deteriorated than the developer satisfying the drive time threshold value.

In the embodiment described above, the processor 154 is configured to set either the normal speed printing sequence or the low speed printing sequence according to the drive time of the developing motor 1304, but is not limited thereto. For example, the processor 154 may set a sequence based on any one or more of the drive time of the developing motor 1304, the number of sheets on which an image is formed, the number of executed print jobs, and the number of rotations of the toner replenishment motor 1301. The processor 154 may set either the normal speed printing sequence or the low speed printing sequence as the sequence. In this case, the memory unit 152 stores the drive time integrated value, the threshold value relating to the number of sheets, the threshold value relating to the number of print jobs, and the threshold value relating to the number of rotations of the toner replenishment motor 1301. The processor 154 may perform image formation in the normal speed printing sequence when a plurality of pieces of measured information does not satisfy any of the respective threshold values. The processor 154 may perform image formation in the low speed printing sequence when the plurality of pieces of measured information satisfies any of the respective threshold values. The plurality of pieces of information are, for example, two or more of the drive time of the developing motor 1304, the number of sheets on which an image is formed, the number of print jobs executed, and the number of rotations of the toner replenishment motor 1301. The threshold values are, for example, threshold values associated with the plurality of pieces of measured information among the drive time integrated value, the threshold value relating to the number of sheets, the threshold value relating to the number of print jobs, and the threshold value relating to the number of rotations of the toner replenishment motor 1301.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:
a printer configured to form an image on a sheet
at a first speed relating to a speed of image formation, or
at a second speed slower than the first speed; and
a controller configured to
measure a drive time of a predetermined apparatus relating to image formation, and
control the printer to
form the image at the first speed when the drive time is less than a threshold value indicating that the developer is deteriorated, and
form the image at the second speed when the drive time is equal to or greater than the threshold value.

2. The image forming apparatus according to claim 1, wherein
the controller further counts a number of sheets on which the image is formed by the image forming apparatus and controls the printer to form the image at the first speed when the number of sheets is less than the threshold value and to form the image at the second speed when the number of sheets is equal to or greater than the threshold value.

3. The image forming apparatus according to claim 1, wherein
the controller further counts a number of print jobs by which the image is formed by the image forming apparatus and controls the printer to form the image at the first speed when the number of print jobs is less than the threshold value and to form the image at the second speed when the number of print jobs is equal to or greater than the threshold value.

4. The image forming apparatus according to claim 1,
wherein the controller further measures a number of rotations of a predetermined motor relating to image formation and controls the printer to form the image at the first speed when the number of rotations is less than the threshold value and to form the image at the second speed when the number of rotations is equal to or greater than the threshold value.

5. An image forming apparatus, comprising:
a printer configured to form an image on a sheet
at a first speed relating to a speed of image formation, or
at a second speed slower than the first speed; and
a controller configured to
acquire information on deterioration of developer contained in the image forming apparatus,
measure a drive time of a predetermined apparatus relating to image formation, and
control the printer to
form the image at the first speed when the drive time is less than a threshold value indicating that the developer is deteriorated, and
form the image at the second speed when the drive time is equal to or greater than the threshold value.

6. The image forming apparatus according to claim 5, wherein the controller further measures a number of rotations of a predetermined motor relating to image formation and controls the printer to form the image at the first speed when the number of rotations is less than the threshold value and to form the image at the second speed when the number of rotations is equal to or greater than the threshold value.

7. The image forming apparatus according to claim 5, wherein the printer forms the image on the sheet at any one of the first speed, the second speed, and a third speed slower than the second speed, and the controller further controls the printer to form the image at the third speed when the information satisfies a second condition indicating that the developer is further deteriorated than when the developer satisfies the predetermined condition.

8. The image forming apparatus according to claim 5, wherein the controller further initializes the acquired information when a developer container accommodated in the image forming apparatus is replaced.

9. The image forming apparatus according to claim 8, wherein the controller further outputs an output relating to replacement of the developer container accommodated in the image forming apparatus to a predetermined output apparatus when the information satisfies the predetermined condition.

10. An image forming method, comprising:

causing an image forming apparatus to form an image on a sheet at a first speed relating to a speed of image formation or at a second speed slower than the first speed;

measuring a drive time of a predetermined apparatus relating to image formation;

forming the image at the first speed when the drive time is less than a threshold value indicating that the developer is deteriorated; and forming the image at the second speed when the drive time is equal to or greater than the threshold value.

11. The method according to claim 10, further comprising:

counting a number of sheets on which the image is formed by the image forming apparatus and forming the image at the first speed when the number of sheets is less than the threshold value and forming the image at the second speed when the number of sheets is equal to or greater than the threshold value.

12. The method according to claim 10, further comprising:

counting a number of print jobs by which the image is formed by the image forming apparatus and forming the image at the first speed when the number of print jobs is less than the threshold value and forming the image at the second speed when the number of print jobs is equal to or greater than the threshold value.

13. The method according to claim 10, further comprising:

measuring a number of rotations of a predetermined motor relating to image formation and forming the image at the first speed when the number of rotations is less than the threshold value and forming the image at the second speed when the number of rotations is equal to or greater than the threshold value.

14. An image forming method, comprising:

causing an image forming apparatus to form an image on a sheet at a first speed relating to a speed of image formation or at a second speed slower than the first speed;

acquiring information on deterioration of developer contained in the image forming apparatus;

measuring a drive time of a predetermined apparatus relating to image formation;

forming the image at the first speed when the drive time is less than a threshold value indicating that the developer is deteriorated; and forming the image at the second speed when the drive time is equal to or greater than the threshold value.

15. The method according to claim 14, further comprising:

forming the image on the sheet at any one of the first speed, the second speed, and a third speed slower than the second speed, and forming the image at the third speed when the information satisfies a second condition indicating that the developer is further deteriorated than when the developer satisfies the predetermined condition.

16. The method according to claim 14, further comprising:

initializing the acquired information when a developer container accommodated in the image forming apparatus is replaced.

17. The method according to claim 14, further comprising:

outputting an output relating to replacement of the developer container accommodated in the image forming apparatus to a predetermined output apparatus when the information satisfies the predetermined condition.

18. The method according to claim 14, further comprising:

counting a number of sheets on which the image is formed by the image forming apparatus and forming the image at the first speed when the number of sheets is less than the threshold value and forming the image at the second speed when the number of sheets is equal to or greater than the threshold value.

19. The method according to claim 14, further comprising:

counting a number of print jobs by which the image is formed by the image forming apparatus and forming the image at the first speed when the number of print jobs is less than the threshold value and forming the image at the second speed when the number of print jobs is equal to or greater than the threshold value.

20. The method according to claim 14, further comprising:

measuring a number of rotations of a predetermined motor relating to image formation and forming the image at the first speed when the number of rotations is less than the threshold value and forming the image at the second speed when the number of rotations is equal to or greater than the threshold value.

* * * * *